US006692104B1

(12) United States Patent
Allen et al.

(10) Patent No.: US 6,692,104 B1
(45) Date of Patent: Feb. 17, 2004

(54) METHOD OF PRINTING MULTI-COLOR COMPOSITION

(75) Inventors: Loretta E. Allen, Hilton, NY (US); David L. Patton, Webster, NY (US); Dale F. McIntyre, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/442,919

(22) Filed: May 21, 2003

(51) Int. Cl.[7] ..... B41J 2/21; B41J 2/01

(52) U.S. Cl. ..... 347/43; 347/105

(58) Field of Search ..... 347/43, 15, 101, 347/105

(56) References Cited

U.S. PATENT DOCUMENTS

| | | | | | |
|---|---|---|---|---|---|
| 4,680,596 | A | * | 7/1987 | Logan | 347/15 |
| 5,839,837 | A | * | 11/1998 | Takehara | 400/76 |
| 5,980,011 | A | * | 11/1999 | Cummins et al. | 347/4 |
| 6,095,636 | A | * | 8/2000 | Shioya et al. | 347/43 |
| 6,227,643 | B1 | | 5/2001 | Purcell et al. | 347/19 |

* cited by examiner

*Primary Examiner*—Thinh Nguyen
(74) *Attorney, Agent, or Firm*—Roger A. Fields

(57) ABSTRACT

A method of printing a multi-color composition having a relatively large background area with a prevailing color and different color smaller objects superimposed on the relatively large background area, comprises: uniformly applying a colored substance that is not a printing ink, and has the same color as the prevailing color of the relatively large background area, on a particular surface; and printing the smaller objects on the particular surface, using different color printing inks.

8 Claims, 3 Drawing Sheets

METHOD OF PRINTING MULTI-COLOR COMPOSITION

CROSS REFERENCE TO RELATED APPLICATION

Reference is made to commonly assigned co-pending application Ser. No. 10/438,598, entitled METHOD OF PRINTING MULTI-COLOR IMAGE and filed May 15, 2003 in the names of Dale F. McIntyre, Loretta E. Allen and David L. Patton.

FIELD OF THE INVENTION

The invention relates generally to printing a multi-color composition such as a simple picture or text, and in particular to printing that includes use of a color ink jet printer.

BACKGROUND OF THE INVENTION

Typically, color ink jet printing is done on a non-colored surface or media such as white paper. Of course, however, the printing can be done on a colored surface or media, such as colored paper. In either instance, a full compliment of the various color printing inks, e.g. cyan, magenta and yellow inks are used. Moreover, the various color printing inks are applied pixel-by-pixel to the selected surface.

When the selected surface originally is colored rather than white, the color of the surface generally bears no relation to the color of the inks to be applied to that surface. Thus, the color of the selected surface does not reduce the amount of inks to be applied, nor does it reduce the time required to apply the inks.

Prior art U.S. Pat. No. 6,227,643 B1 issued May 8, 2001 briefly mentions that, preparatory to color ink jet printing, information is obtained which is indicative of an original color of the selected surface to which the inks are to be applied. This is done in order to modify the digital printing file to correct for any color aberrations caused by the original color of the selected surface.

The Cross-referenced Application

The cross-referenced application discloses a method of printing a multi-color image on a particular surface, using a digital image file having a discrete number of pixels that collectively represent the multi-color image.

The method comprises:

determining a relatively large area of the multi-color image that is represented by less than the total number of pixels, but which pixels each have a common printing color component;

forming an outline of the determined relatively large image area on the particular surface the multi-colored image is to be printed;

providing a colored receiver layer within the formed outline that is the same color as the common color component, but which color has a selected low color value;

applying a non-colored receiver to an area on the particular surface that is outside the formed outline on the particular surface, to provide a non-colored receiver layer on the particular surface in addition to the colored receiver layer on the particular surface;

modifying the digital image file by subtracting the selected low color value from the pixels representing the relatively large area, to provide a printing file for printing the multi-color image; and printing the multi-color image on the colored and non-colored receiver layers, using the printing file, to make a print of the multi-color image on the particular surface.

SUMMARY OF THE INVENTION

A method of printing a multi-color composition having a relatively large background area with a prevailing color and different color smaller objects superimposed on the relatively large background area, comprises:

uniformly applying a colored substance that is not a printing ink, and has the same color as the prevailing color of the relatively large background area, on a particular surface; and printing the smaller objects on the particular surface, using different color printing inks.

DETAILED DESCRIPTION OF THE INVENTION

The invention is a method of printing a multi-color composition such as a simple picture, text or symbols preferably on a large size surface such as a wall or roadside billboard, using a digital pixel file having a discrete number of pixels that collectively represent the multi-color composition. The digital pixel file can be produced by any one of a number of known ways. For example, it can be produced by scanning a multi-color composition that exists as printed matter or as a film negative or positive, it can be produced from a captured composition in a digital camera, it can be produced from a computer created composition on a liquid crystal display, etc. Moreover, printing the multi-color composition is done preferably using a known ink jet printer that has cyan, magenta and yellow printing inks.

Figure 1:
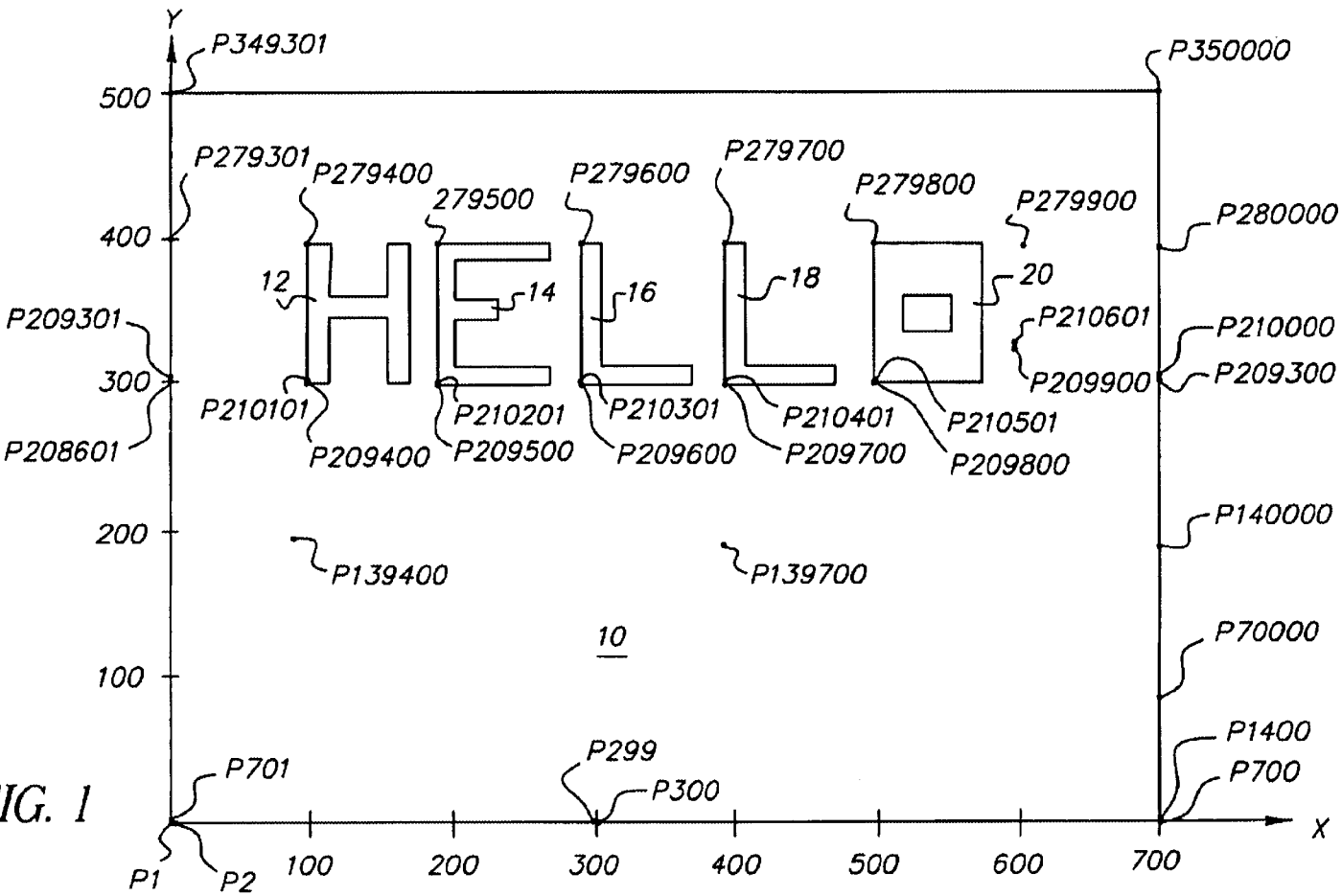
FIG. 1 depicts an X-axis, Y-axis pattern of pixels P1–P350000 that collectively represent a multi-color composition to be printed on a particular (selected) surface.

The digital pixel file representing the multi-color composition may, for example, have 350,000 pixels, i.e. pixels P1–P350000, arranged in an X-axis, Y-axis pattern of 700 pixels x 500 pixels as indicated in FIG. 1. The X-axis, Y-axis pattern permits an assignment of X and Y coordinates to each pixel, so that the location or position of each pixel can be readily determined in the context of the multi-color composition according to a known methodology. By way of example in FIG. 1, the pixel PI would have the X,Y coordinates 1, 1, the pixel P2 would have the X,Y coordinates 2,1, the pixel P299 would have the X,Y coordinates 299,1, the pixel P300 would have the X,Y coordinates 300,1, the pixel P700 would have the X,Y coordinates 700,1, the pixel P701 would have the X,Y coordinates 1,2, the pixel P1400 would have the X,Y coordinates 700,2, the pixel P70000 would have the X,Y coordinates 700,100, the pixel P 140000 would have the X,Y coordinates 700,200, the pixel P209300 would have the X,Y coordinates 700,299, the pixel P210000 would have the X,Y coordinates 700,300, the pixel P280000 would have the X,Y coordinates 700,400, the pixel P350000 would have the X,Y coordinates 700,500, the pixel P349301 would have the X,Y coordinates 1,500, the pixel P279301 would have the X,Y coordinates 1,400, the pixel P279400 would have the X,Y coordinates 100,400, the pixel P279500 would have the X,Y coordinates 200,400, the pixel P279600 would have the X,Y coordinates 300,400, the pixel P279700 would have the X,Y coordinates 400,400, the pixel P279800 would have the X,Y coordinates 500,400, the pixel P279900 would have the X,Y coordinates 600,400, the pixel P209301 would have the X,Y coordinates 1,300, the pixel P209400 would have the X,Y coordinates 100,300, the pixel P209500 would have the X,Y coordinates 200,300, the pixel P209600 would have the X,Y coordinates 300,300, the pixel P209700 would have the X,Y coordinates 400,300, the pixel P209800 would have the X,Y coordinates 500,300, the pixel P209900 would have the X,Y coordinates 600,300, the pixel P208601 would have the X,Y coordinates 1,299, the pixel P139400 would have the X,Y coordinates 100,200, the pixel P139700 would have the X,Y coordinates 400,200, the pixel P210101 would have the X,Y coordinates 101,301, the pixel P210201 would have the X,Y coordinates 201,301, the pixel P210401 would have the X,Y coordinates 401,301, the pixel P210501 would have the X,Y coordinates 501,301, and the pixel P210601 would have the X,Y coordinates 601,301. The X,Y coordinates of the remaining pixels in the digital pixel file can easily be extrapolated from FIG. 1. Thus, the digital pixel file includes the X,Y coordinates of each pixel in the file.

As viewed in FIG. 1, the pixels P1–P350000 representing the multi-color composition fall generally into two groups. The first group represents a relatively large background area 10 in the multi-color composition, which has a single or prevailing uniform color. The second group represents different color smaller objects 12, 14, 16, 18 and 20, i.e. the letters "H", "E", "L", "L", and "O", in the multi-color composition, which are superimposed on the relatively large background area. The color of each smaller object 12, 14, 16, 18 and 20, i.e. each letter "H", "E", "L", "L", and "O", may the same or different. However, such color must be different than the single or prevailing color of the relatively large background area 10.

Each pixel P1–350000 can have a cyan (C) color component and/or a magenta (M) color component and/or a yellow (Y) color component. In turn, each C, M and Y color component has an individual color value of 0–255.

Figure 2:
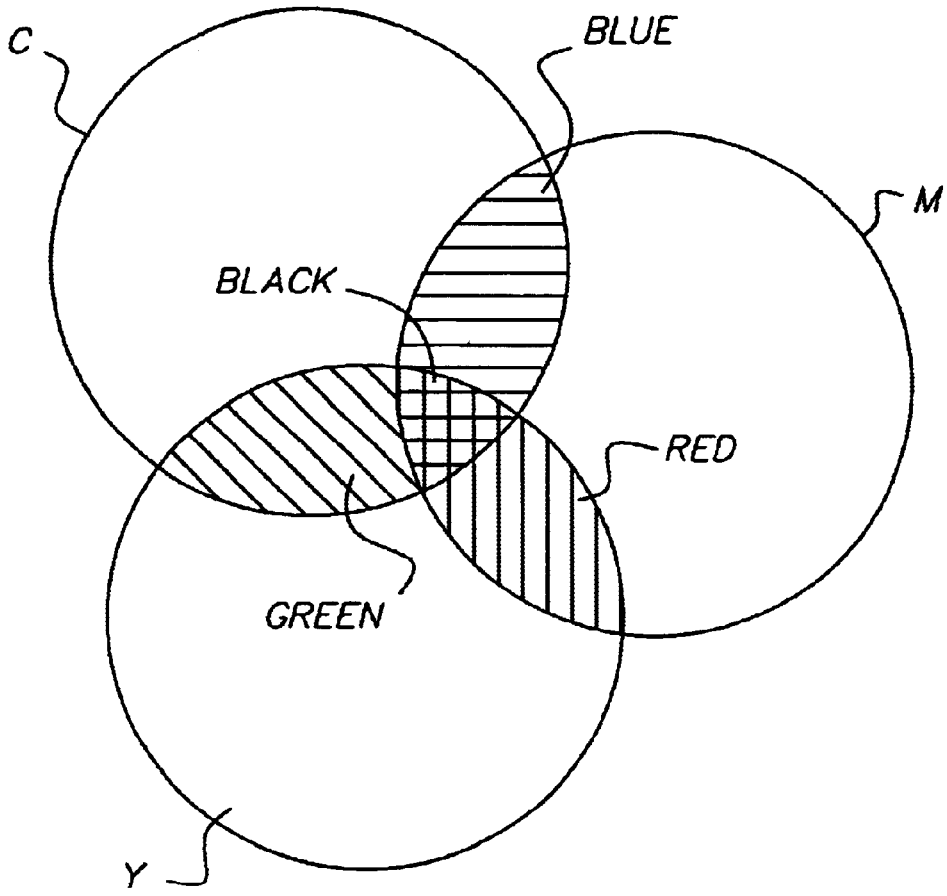
FIG. 2 is a cyan, magenta and yellow color ink mixing chart showing the mixing of these color inks to produce red, green, blue and black.

As shown in FIG. 2, mixing the C and M color components generally produces the resultant color blue (BLUE). Mixing the C and Y color components generally produces the resultant color green (GREEN). Mixing the M and Y color components generally produces the resultant color red (RED). And mixing the C, M and Y color components substantially equally produces black (BLACK).

Figure 3:
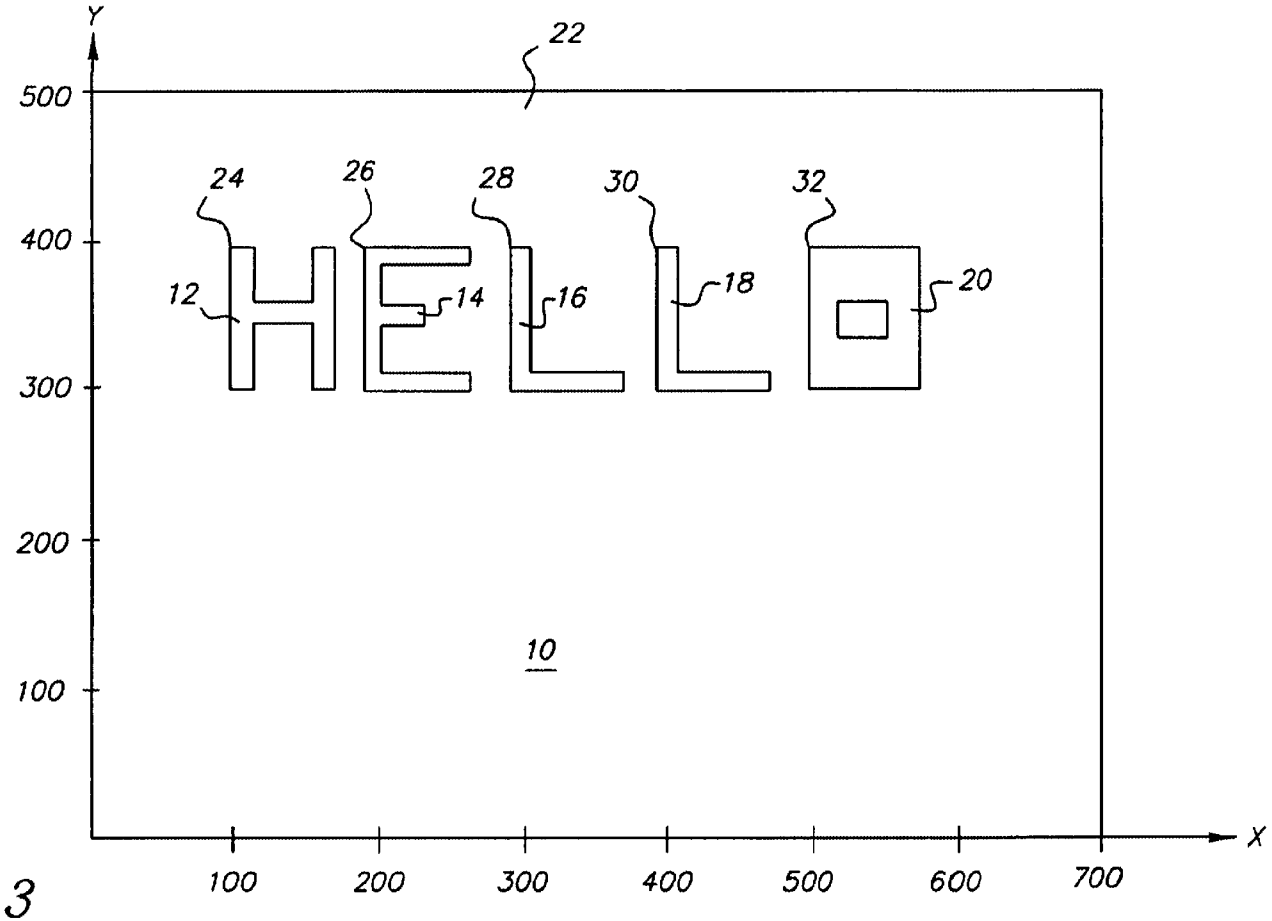
FIG. 3 depicts the multi-color composition printed on a particular (selected) surface.

A preferred embodiment of the method of printing the multi-color composition consisting of the relatively large background area 10 that has a single or prevailing color, and the different color smaller objects 12, 14, 16, 18 and 20, i.e. the letters "H", "E", "L", "L", and "O", superimposed on the relatively large background, using the digital pixel file, has the following steps. The multi-color composition can be printed on a particular (selected) surface 22 as shown in FIG. 3.

STEPS 1–3

Step 1 involves opening the digital pixel file and reviewing the file pixel-by-pixel as indicated in the TABLE which follows. However, for the sake of brevity, only some of the pixels P1–P35000 are included in the TABLE. Some of the pixels in the TABLE represent the relatively large background area 10 and other pixels in the TABLE represent the smaller objects 12, 14, 16, 18 and 20, i.e. the letters "H", "E", "L", "L", and "O", superimposed on the relatively large background.

TABLE

| Color Pixels (P1–P350000) | X,Y Pixel Coordinates (STEP 1) | C, M, Y Color Values (0–255) Per Pixel (STEP 1) | Resultant Color Per Pixel (STEPS 2, 3) | Composition Component (STEP 3) |
|---|---|---|---|---|
| P1-P210000 | 1,1–700,300 | 110,110,0 | Blue | Background area 10 |
| P279301–P350000 | 1,400,–700,500 | 110,110,0 | Blue | Background Area 10 |
| P210101 | 101,301 | 0,120,120 | Red | Object 12, i.e. Letter "H" |
| P210201 | 201,301 | 0,120,120 | Red | Object 14, i.e. Letter "E" |
| P210301 | 301,301 | 0,120,120 | Red | Object 16, i.e. Letter "L" |
| P210401 | 401,301 | 0,120,120 | Red | Object 18, i.e. Letter "L" |
| P210501 | 501,301 | 0,120,120 | Red | Object 20, i.e. Letter "O" |
| P210601 | 601,301 | 110,110,0 | Blue | Background Area 12 |

STEP 1 in the TABLE calls for reviewing the digital image file pixel-by-pixel, to identify the X,Y coordinates of each pixel, and the C, M, and Y color values of each pixel.

STEP 2 in the TABLE calls for determining the resultant color to be produced per pixel by mixing the C, M, and Y color values per pixel. For example, mixing the color values C=110, M=110, and Y=0 of the pixel P1, produces the color blue.

STEP 3 in the TABLE calls for determining which one of the resultant colors blue or red is the most prevalent in the multi-color composition. The TABLE indicates that the resultant color blue is more prevalent than the resultant color red, since the resultant color for the majority of pixels is blue—whereas the resultant color for the remaining lesser number of pixels is red. Moreover, as can be gleaned from the TABLE, the background area 10 is the color blue, and each of the objects, 12, 14, 16, 18, and 20, i.e. the letters "H", "E", "L", "L", and "O", is the color red. Thus, since the background area 10 is the more prevalent color blue, it is judged to be relatively larger than the combination of objects, 12, 14, 16, 18, and 20, i.e. the combination of letters "H", "E", "L", "L", and "O".

STEP 4

STEP 4 calls for forming respective outlines 24, 26, 28, 30, and 32, on the particular surface 22, of each of the objects, 12, 14, 16, 18, and 20, i.e. each of the letters "H", "E", "L", "L", and "O". See FIG. 3. This can be readily done since the X,Y coordinates of the pixels P1–P350000 have been determined to identify the position or location of each pixel in the multi-color composition. More specifically, the X,Y coordinates of each of the objects, 12, 14, 16, 18, and 20, i.e. each of the letters "H", "E", "L", "L", and "O", are known. See STEP 3 in the TABLE.

STEP 5

STEP 5 calls for uniformly applying a colored substance that is not a printing ink, e.g. a paint, on the particular surface 22, but limited to outside the formed outlines 24, 26, 28, 30, and 32 on the particular surface. The colored substance has the same color as the color of the background area 10, which is blue, and it can be hand-rolled or sprayed on the particular surface 22.

Alternatively, the colored substance can be applied to the entirety of the particular surface 22 to form a colored receiver layer for the objects, 12, 14, 16, 18, and 20, i.e. the letters "H", "E", "L", "L", and "O". In this instance, STEP 4 would be omitted since it is not necessary. Also, the colored substance is like a paint primer so that cyan, magenta and yellow printing inks will readily adhere to the colored receiver layer.

However, when STEP 4 is not omitted, an optional non-colored substance can be applied to the particular surface 22, but limited to within the formed outlines 24, 26, 28, 30, and 32. The non-colored substance may be an ink-compatible white paint that can be hand-rolled or sprayed on the particular surface 22, within the formed outlines 24, 26, 28, 30, and 32.

STEP 6

STEP 6 calls for color ink printing the objects, 12, 14, 16, 18, and 20, i.e. the letters "H", "E", "L", "L", and "O" on the particular surface 22, within the formed outlines 24, 26, 28, 30, and 32, using the digital pixel file as a printing guide, and using magenta and yellow printing inks to produce the color red, according to known techniques. This can be accomplished with a known ink jet printer.

The invention has been described in detail with particular reference to certain preferred embodiments thereof, but it will be understood that variations and modifications can be effected within the spirit and scope of the invention.

PARTS LIST

10. relatively large background area
12. letter "H"
14. letter "E"
16. letter "L"
18. letter "L"
20. letter "O"
22. particular surface
24. "H" outline
26. "E" outline
28. "L" outline
30. "L" outline
32. "O" outline

What is claimed is:

1. A method of printing a multi-color composition having a relatively large background area with a prevailing color and different color smaller objects superimposed on the relatively large background area, said method comprising:

uniformly applying a colored substance that is not a printing ink, and has the same color as the prevailing color of the relatively large background area, on a particular surface; and printing the smaller objects on the particular surface, using different color printing inks.

2. A method as recited in claim 1, wherein the colored substance is applied to the particular surface by painting the particular surface.

3. A method as recited in claim 1, wherein the multi-color composition is represented by a discrete number of pixels that constitute a digital pixel file, and the digital pixel file is reviewed pixel-by-pixel to determine the pixels that represent the relatively large area and the pixels that represent smaller objects.

4. A method as recited in claim 3, wherein the digital pixel file is reviewed pixel-by-pixel to determine the X,Y coordinates of the pixels that represent the smaller objects to form outlines of such objects on the particular surface.

5. A method as recited in claim 3, wherein the digital pixel file is reviewed pixel-by-pixel to determine a resultant color of each pixel and in turn determine the most prevalent color in the multi-color composition identify the relatively larger background area.

6. A method as recited in claim 1, wherein the colored substance is applied to the entirety of the particular surface to form a colored receiver layer, and the smaller objects are ink printed on the colored receiver layer.

7. A method as recited in claim 1, wherein the colored substance is applied to the particular surface except for those portions of the particular surface on which the smaller objects are to be ink printed, and the smaller objects are ink printed on such portions.

8. A method as recited in claim 7, wherein a non-colored substance is applied to the portions of the particular surface on which the smaller objects are to be ink printed, before the smaller objects are ink printed on such portions.

* * * * *